US009573129B2

(12) United States Patent
Lee et al.

(10) Patent No.: US 9,573,129 B2
(45) Date of Patent: Feb. 21, 2017

(54) SENSING SYSTEM AND SENSOR CHIP THEREOF

(71) Applicant: National Chiao Tung University, Hsinchu (TW)

(72) Inventors: Chen-Yi Lee, Hsinchu (TW); Kelvin Yi-Tse Lai, Changhua County (TW); Yu-Tao Yang, Koahsiung (TW)

(73) Assignee: National Chiao Tung University, Hsinchu (TW)

( * ) Notice: Subject to any disclaimer, the term of this patent is extended or adjusted under 35 U.S.C. 154(b) by 253 days.

(21) Appl. No.: 14/341,466

(22) Filed: Jul. 25, 2014

(65) Prior Publication Data

US 2015/0268185 A1 Sep. 24, 2015

(30) Foreign Application Priority Data

Mar. 20, 2014 (TW) ..... 103110503 A

(51) Int. Cl.
*B01L 3/00* (2006.01)

(52) U.S. Cl.
CPC .. *B01L 3/502792* (2013.01); *B01L 2400/0427* (2013.01)

(58) Field of Classification Search
CPC ..... B01L 3/502784–3/502792; B01L 2200/06–2200/0694; B01L 2400/0406–2400/0427
USPC ..... 204/450, 547, 549, 643, 645
See application file for complete search history.

(56) References Cited

U.S. PATENT DOCUMENTS

2011/0247934 A1* 10/2011 Wang ..... B01L 3/502792 204/450

FOREIGN PATENT DOCUMENTS

| | | | |
|---|---|---|---|
| JP | 2004-309614 | A | 11/2004 |
| JP | 2005-510347 | A | 4/2005 |
| JP | 2009-86621 | A | 4/2009 |
| JP | 2013-156630 | A | 8/2013 |
| TW | I354733 | | 3/2008 |
| TW | I383144 | | 1/2013 |
| WO | 2013121522 | A1 | 8/2013 |

OTHER PUBLICATIONS

Luan, et al., "Integrated Optical Sensor in a Digital Microfluidic Platform." IEEE Sensors Journal, May 2008.
Srinivasan, et al., "An Integrated Digital Microfluidic Lab-on-a-chip for Clinical Diagnostics on Human Physiological Fluids.", The Royal Society of Chemistry, Apr. 2004.
Wang, et al., "Digital Microfluidic Operations on Micro-electrode Dot Array Architecture.", IET Nanobiotechniology, 2011.

* cited by examiner

*Primary Examiner* — Bach Dinh
(74) *Attorney, Agent, or Firm* — Cesari and McKenna, LLP; James A. Blanchette

(57) ABSTRACT

A sensing system includes a processing unit and sensor chip. The sensor chip includes a microelectrode array, a droplet space over the microelectrode array, and a plurality of control units coupled together in a daisy-chain configuration. Each of the control units is coupled to a respective one of the microelectrodes of the microelectrode array. The control units are controlled by the processing unit to drive movement of a droplet in the droplet space, and to inspect the droplet via the microelectrodes.

16 Claims, 6 Drawing Sheets

SENSING SYSTEM AND SENSOR CHIP THEREOF

CROSS-REFERENCE TO RELATED APPLICATIONS

This application claims the benefit of Taiwan Application No. 103110503, filed on Mar. 20, 2014. The content of which is hereby incorporated by reference in its entirety.

BACKGROUND OF THE INVENTION

Field of the Invention

The invention relates to a sensing system and a sensor chip, and more particularly to a sensing system including a sensor chip with a microelectrode array.

Background Information

Due to the longer lifespan, physical examinations have become increasingly important in respect of disease screening, medical diagnosis or geriatric care. In conventional analysis, a to-be-inspected portion of a specimen is separated using a centrifuge. After adding some reagents, a condition of the specimen may be determined according to a presented color or a concentration of a product. Such a conventional method requires more manpower and time for analysis, resulting in a relatively high cost.

On the other hand, biochips contribute to fast and effective analysis, and are suitable for use at home, achieving both reduction of personnel cost and increasing popularity. An LOC (laboratory-on-a-chip), also called a μTAS (micro total analytical system), microminiaturizes and integrates on a chip operations in a lab, resulting in reduced overall reaction time, promoted efficiency, and significant reduction in inspection errors. Such integration of medical analysis and electronic system saves time, space and human resource, thereby greatly reducing cost, and being a potentially important product in the future.

Most conventional LOCs use a glass substrate to build thereon, a set of micro flow paths and valve components that control the micro flow paths, based on MEMS (micro-electro-mechanical system) techniques and a semiconductor fabrication process, and cooperate with external pump devices and inspection devices to form a platform for completely processing and analyzing specimens. Separation and purification of the specimen, mixing of the specimen and the reagents, and judgment of the result may be provided using such a platform.

However, the LOC with the micro flow paths and the valve components may encounter the following issues:

1. Due to difficulty in heterogenous integration, control components and inspection components for the LOC must be setup externally. In general, a large number of the external control components lead to a large number of input/output (I/O) signal lines, resulting in limitations on usable area of the LOC.

2. Most LOCs cooperate with an external pump to enable flow of a droplet in the micro flow paths from a position with a relatively high pressure to a position with a relatively low pressure. However, since the micro flow paths are in a sealed space, the pressure generated by the pump may cause the droplet to flow arbitrarily, leading to ineffective driving of the droplet, waste of the specimen, and low sensitivity in analysis.

3. Since a layout of the micro flow paths of the conventional LOC is fixed, the LOCs with different layouts of the micro flow paths may be required for different analysis. Personnel may need to learn operations for the LOCs with different layouts of the micro flow paths, leading to higher costs in training personnel and product development.

4. Although many methods have been proposed to control fluid in the micro flow paths, the applicant is not aware of a conventional method that additionally provides a mechanism enabling readout of a type of the fluid, which may reduce errors in experiments.

SUMMARY OF THE INVENTION

Therefore, an object of the present invention is to provide a sensing system that may have a relatively smaller number of input/output signal lines, that may effectively drive movement of a specimen, that facilitates inspection of the specimen, and that enables readout of a type of the specimen.

According to one aspect of the present invention, a sensing system comprises:

a processing unit configured to generate a data input signal, a clock signal, and a control input; and a sensor chip including:

a microelectrode array including a plurality of microelectrodes spaced apart from each other;

a cover disposed over the microelectrode array, disposed to receive a bias voltage signal, and formed with a droplet space for accommodating a droplet; and a plurality of control units, each of which includes a data input terminal and a data output terminal, is coupled to the processing unit for receiving the clock signal and the control input therefrom, and is coupled to a corresponding one of the microelectrodes for providing a microelectrode signal thereto. The data input terminal of a first one of the control units receives the data input signal from the processing unit, and the data input terminal of each of other ones of the control units is coupled to the data output terminal of another one of the control units, such that the control units are coupled together in a daisy chain configuration.

Another object of the present invention is to provide a sensor chip for a sensing system.

According to another aspect of the present invention, a sensor chip comprises:

a microelectrode array including a plurality of microelectrodes spaced apart from each other;

a cover disposed over the microelectrode array, disposed to receive a bias voltage signal, and formed with a droplet space for accommodating a droplet; and a plurality of control units, each of which includes a data input terminal and a data output terminal, is disposed to receive a clock signal and a control input, and is coupled to a corresponding one of the microelectrodes for providing a microelectrode signal thereto. The data input terminal of a first one of the control units is disposed to receive a data input signal, and the data input terminal of each of other ones of the control units is coupled to the data output terminal of another one of the control units, such that the control units are coupled together in a daisy chain configuration.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF AN ILLUSTRATIVE EMBODIMENT

Figure 1:
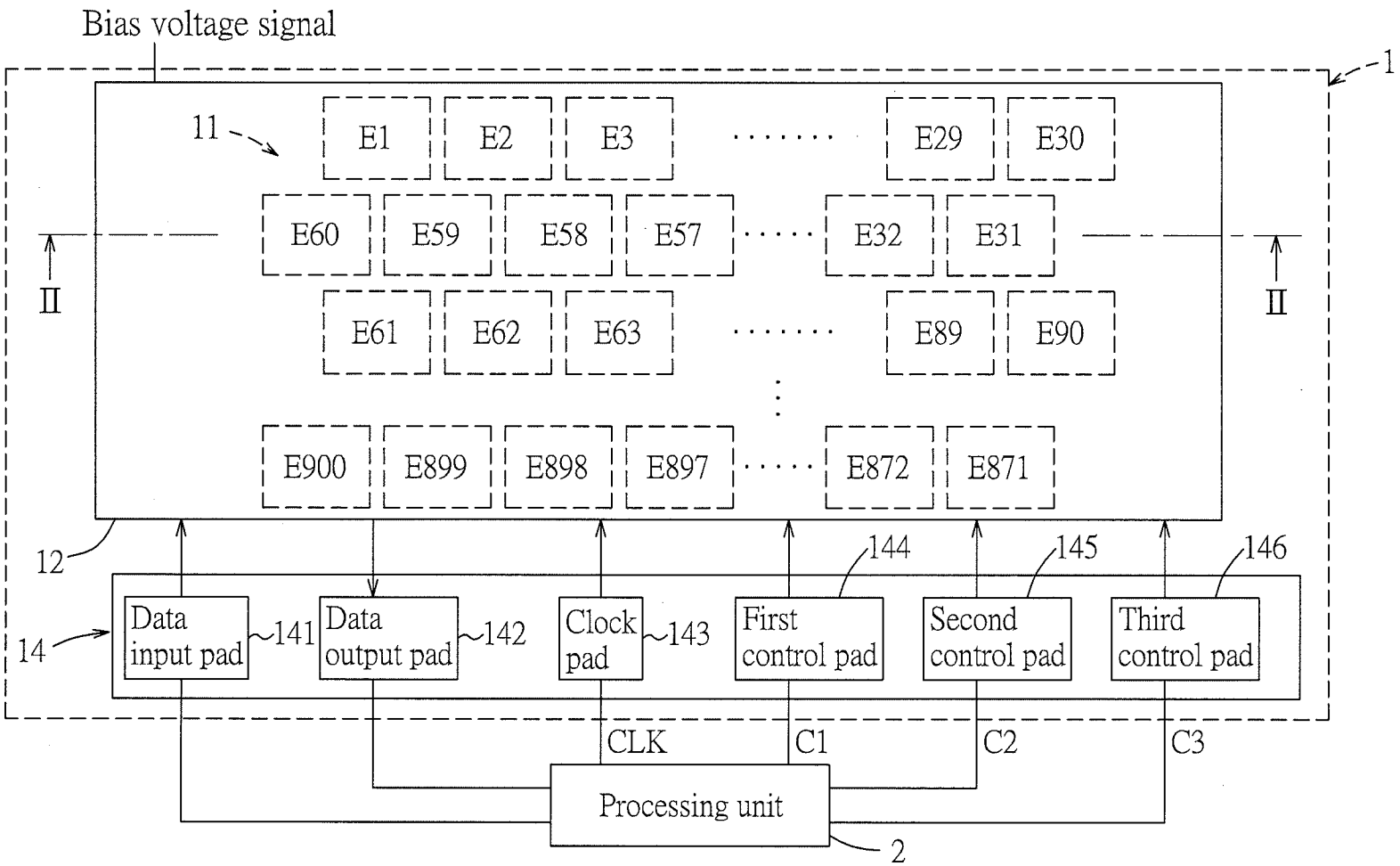
FIG. 1 is a schematic diagram showing a top view of a preferred embodiment of the sensing system according to the present invention.
Figure 2:
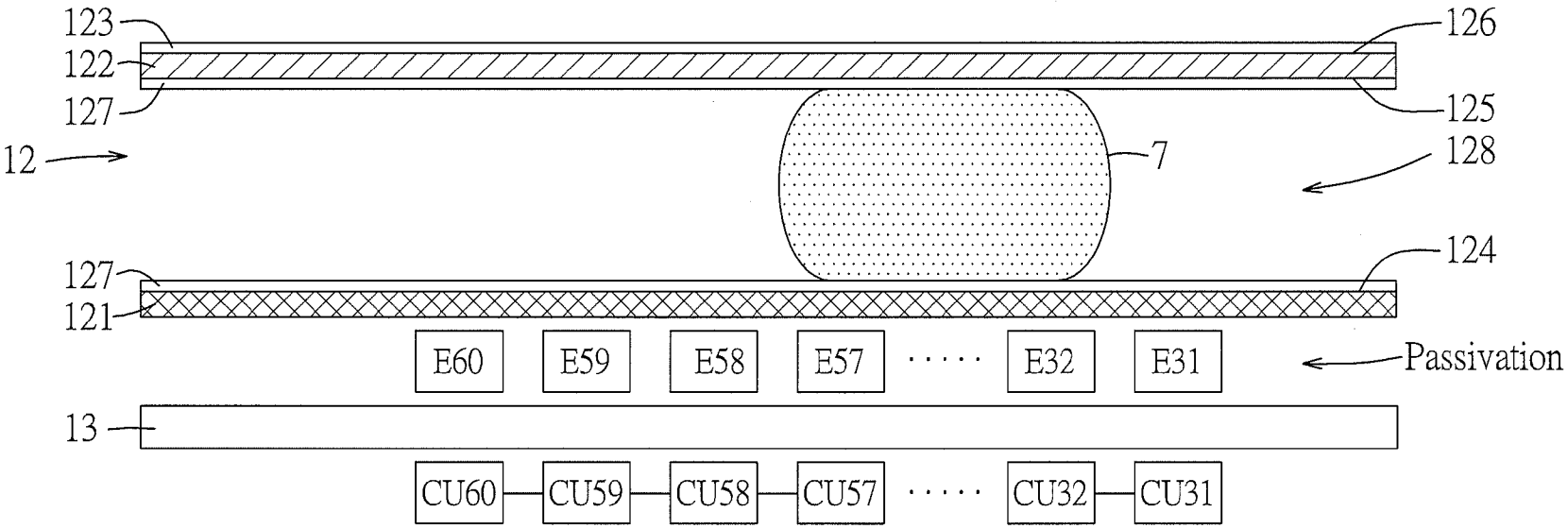
FIG. 2 is a schematic diagram showing a sectional view of the preferred embodiment taken along line II-II in FIG. 1.

Referring to FIGS. 1 and 2, the preferred embodiment of the sensing system according to this invention is shown to include a sensor chip 1 and a processing unit 2. The sensor chip 1 includes a microelectrode array 11, a cover 12, a shielding layer 13, a plurality of control units CU1-CU900, and a bonding area 14. In this embodiment, the sensing system is a biological sensing system for sensing a biological specimen, and the sensor chip 1 is a biochip, but the present invention should not be limited in this respect.

In this embodiment, the microelectrode array 11 is a microelectrode dot array (MEDA) that includes a plurality of square-shaped microelectrodes E1-E900 that are spaced apart from each other, and that are arranged in a 30×30 square-shaped array. In other embodiments, the microelectrodes E1-E900 may be arranged in other desired shapes, and a single microelectrode may be formed in a hexagon, other polygon types, a circle or an irregular shape.

The cover 12 is disposed over the microelectrode array 11, and includes a first dielectric layer 121, a second dielectric layer 122 disposed over and spaced apart from the first dielectric layer 121, two hydrophobic layers 127, a conductive layer 123, and a droplet space 128. The first dielectric layer 121 has a first surface 124 opposite to the microelectrode array 11. The second dielectric layer 122 has a second surface 125 facing the first dielectric layer 121, and a third surface 126 opposite to the second surface 125.

The hydrophobic layers 127 are respectively formed on the first surface 124 of the first dielectric layer 121 and the second surface 125 of the second dielectric layer 122, and form the droplet space 128 therebetween for accommodating a droplet 7 of a specimen. The conductive layer 123 is formed on the third surface 126 of the second dielectric layer 122, and receives a bias voltage signal.

In this embodiment, the first dielectric layer 121 is used for protecting the microelectrode array 11 from oxidation and contact with the droplet 7. The second dielectric layer 122 is made of a glass material. The conductive layer 123 is made of ITO (indium tin oxide). The hydrophobic layers 127 are made of polytetrafluoroethylene (PTFE) for reducing friction between the hydrophobic layers 127 and the droplet 7 in the droplet space 128, thereby facilitating driving movement of the droplet 7.

In this embodiment, each of the control units CU1-CU900 is disposed under a corresponding one of the microelectrodes E1-E900. The shielding layer 13 is disposed between the microelectrode array 11 and the control units CU1-CU900 for shielding the control units CU1-CU900 from electromagnetic interference resulting from the cover 12. The shielding layer 13 may receive a constant voltage or may be floating.

Each of the control units CU1-CU900 is coupled to the corresponding one of the microelectrodes E1-E900 for providing a microelectrode signal thereto, is coupled to the processing unit 2 for receiving a clock signal CLK and a control input generated thereby, and includes a data input terminal for receiving a signal input SI, and a data output terminal for outputting a signal output SO. The control unit CU1 receives at the data input terminal thereof a data input signal from the processing unit 2 that serves as the signal input SI thereof, and the data input terminal of each of other ones of the control units CU2-CU900 is coupled to the data output terminal of another one of the control units CU1-CU899, such that the control units CU1-CU900 are coupled together in a daisy chain configuration. In this embodiment, the control input generated by the processing unit 2 includes a first control signal C1, a second control signal C2 and a third control signal C3.

Figure 3:
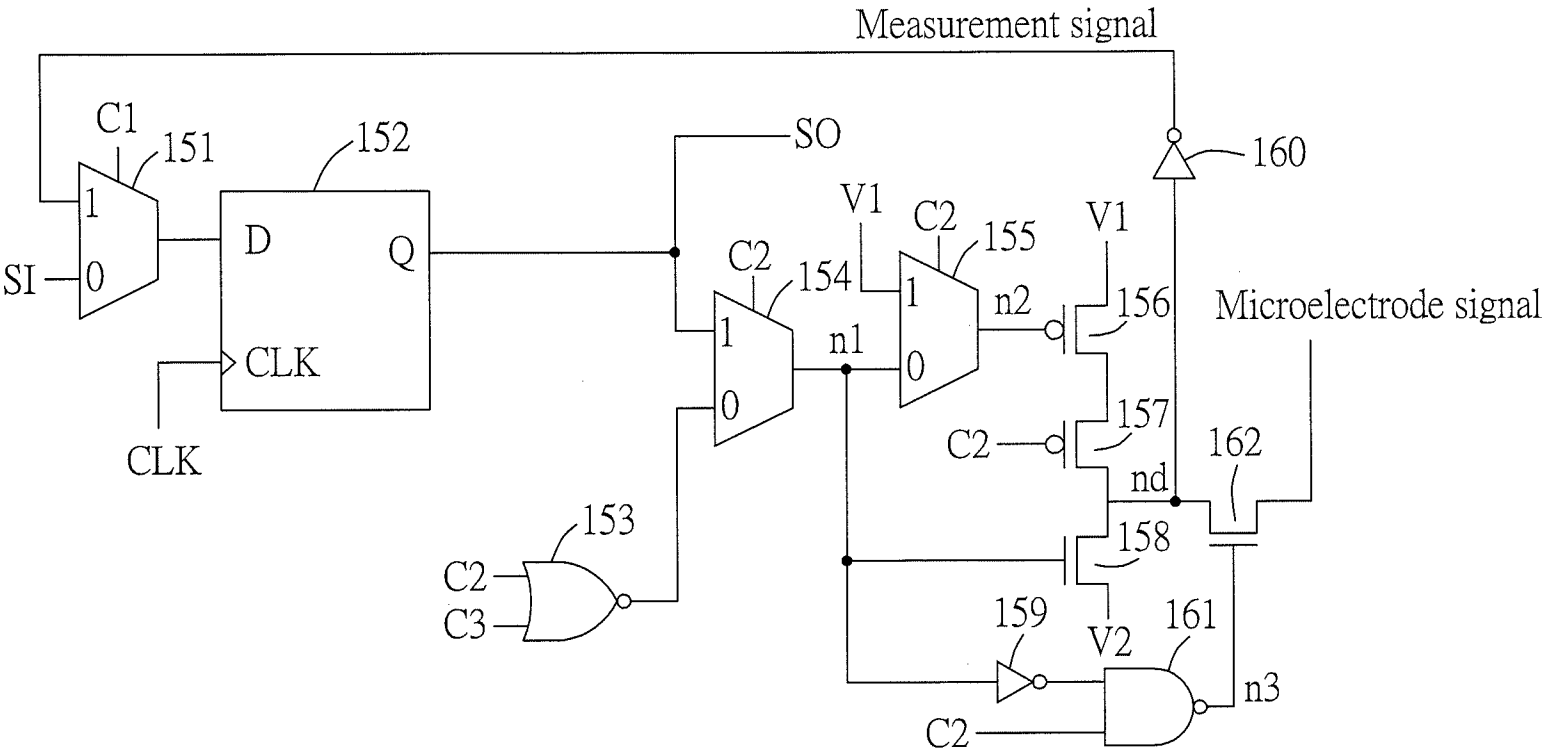
FIG. 3 is a schematic circuit diagram illustrating a control unit of the preferred embodiment.

Referring to FIG. 3, each of the control units CU1-CU900 is shown to include a first multiplexer 151, a D flip-flop 152, a NOR gate 153, a second multiplexer 154, a third multiplexer 155, a first transistor 156, a second transistor 157, a third transistor 158, a first inverter 159, a second inverter 160, a NAND gate 161 and a switch component 162.

The first multiplexer 151 has a first input receiving a measurement signal, a second input serving as the data input terminal of the control unit, a select input receiving the first control signal C1, and an output. The first multiplexer 151 is configured to output the signal input SI when the first control signal C1 has a first logic value, which is logic 0 in this embodiment, and to output the measurement signal when the first control signal C1 has a second logic value, which is logic 1 in this embodiment.

The D flip-flop 152 has a data input coupled to the output of the first multiplexer 151, a clock input receiving the clock signal CLK generated by the processing unit 2, and an output serving as the data output terminal of the control unit. The D flip-flop 152 stores and provides at the output thereof the logic value at the output of the first multiplexer 151 upon trigger of a positive edge of the clock signal CLK.

The NOR gate 153 has a first input receiving the second control signal C2, and a second input receiving the third control signal C3, and an output.

The second multiplexer 154 has a first input coupled to the output of the D flip-flop 152 for receiving the signal output SO, a second input coupled to the output of the NOR gate 153, a select input receiving the second control signal C2, and an output outputting a first intermediate signal n1. The second multiplexer 154 is configured to output a signal at the output of the NOR gate 153 to serve as the first intermediate signal n1 when the second control signal C2 has the first logic value, and to output the signal output SO to serve as the first intermediate signal n1 when the second control signal C2 has the second logic value.

The third multiplexer 155 has a first input receiving a first reference voltage V1, a second input coupled to the output of the second multiplexer 154, a select input receiving the second control signal C2, and an output outputting a second intermediate signal n2. The third multiplexer 155 is configured to output the first intermediate signal n1 to serve as the second intermediate signal n2 when the second control signal C2 has the first logic value, and to output the first reference voltage V1 to serve as the second intermediate signal n2 when the second control signal C2 has the second logic value.

The first, second and third transistors 156, 157, 158 are coupled in series in the given order between a source of the first reference voltage V1 and a source of a second reference voltage V2, and make or break electrical connections in response to the second intermediate signal n2, the second control signal C2, and the first intermediate signal n1, respectively. In this embodiment, the first and second transistors 156, 157 are P-type metal-oxide-semiconductor field-effect transistors (MOSFET), and the third transistor 158 is an N-type MOSFET. The first reference voltage V1 may also be denoted as VDD, which has a voltage level of logic 1, and the second reference voltage V2 is a ground-node voltage, which is smaller than the first reference voltage V1, and which has a voltage level of logic 0. In this embodiment, a voltage level of logic 0 is capable of causing the N-type MOSFET (i.e., the transistor 158) to break electrical connection and causing the P-type MOSFETs (i.e., the transistors 156, 157) to make electrical connections, and a voltage level of logic 1 is capable of causing the N-type MOSFET (i.e., the transistor 158) to make electrical connection and causing the P-type MOSFETs (i.e., the transistors 156, 157) to break electrical connections.

The first inverter 159 has an input coupled to the output of the second multiplexer 154 for receiving the first intermediate signal n1, and an output.

The NAND gate 161 has a first input coupled to the output of the first inverter 159, a second input receiving the second control signal C2, and an output outputting a third intermediate signal n3.

The switch component 162 has a first terminal coupled to a common node nd of the second and third transistors 157, 158, a second terminal coupled to the corresponding one of the microelectrodes E1-E900 for providing the microelectrode signal thereto, and a control terminal coupled to the output of the NAND gate 161 so as to make or break electrical connection between the first and second terminals of the switch component 162 in response to the third intermediate signal n3. When the switch component 162 makes electrical connection, the microelectrode signal is generated and has a voltage level the same as that at the node nd. In this embodiment, the switch component 162 is an N-type MOSFET.

The second inverter 160 has an input coupled to the node nd, and an output outputting the measurement signal to the first input of the first multiplexer 151.

Referring once again to FIG. 1, the bonding area 14 includes a data input pad 141 coupled to the data input terminal of the control unit CU1, and a data output pad 142 coupled to the data output terminal of the control unit CU900, which is that last one of the control units CU1-CU900 in the daisy chain configuration, and further includes a clock signal pad 143 and a control pad unit (i.e., a first control pad 144, a second control pad 145 and a third control pad 146) that are coupled to each of the control units CU1-CU900. By virtue of the daisy chain configuration, the data output terminal of each of the control units CU1 to CU899 is coupled to the data input terminal of an adjacent one of the control units CU2 to CU900, so that a required number of input/output (I/O) pins is significantly reduced. The reduced number of I/O pins makes it possible to arrange the bonding area 14 at a side of the microelectrode array 11 which is not under the cover 12, thereby reducing difficulty in positioning the second dielectric layer 122 (i.e., the glass) in a manufacturing process of the sensor chip 1, and avoiding bonding wires (not shown) from being damaged by the second dielectric layer 122 in the manufacturing process.

The processing unit 2 is coupled to the data input pad 141, the data output pad 142, the clock pad 143, the first control pad 144, the second control pad 145 and the third control pad 146, generates the clock signal CLK, the first control signal C1, the second control signal C2 and the third control signal C3 that are provided to each of the control units CU1-CU900 respectively via the clock pad 143, the first control pad 144, the second control pad 145 and the third control pad 146, generates the data input signal provided to the control unit CU1 via the data input pad 141, and receives a data output signal from the data output terminal of the control unit CU900 (i.e., the signal output SO of the control unit CU900) via the data output pad 142.

It should be noted that, in this embodiment, the processing unit 2 is separated from the sensor chip 1, but in other embodiments, the processing unit 2 may be integrated with the sensor chip 1.

Figure 4:
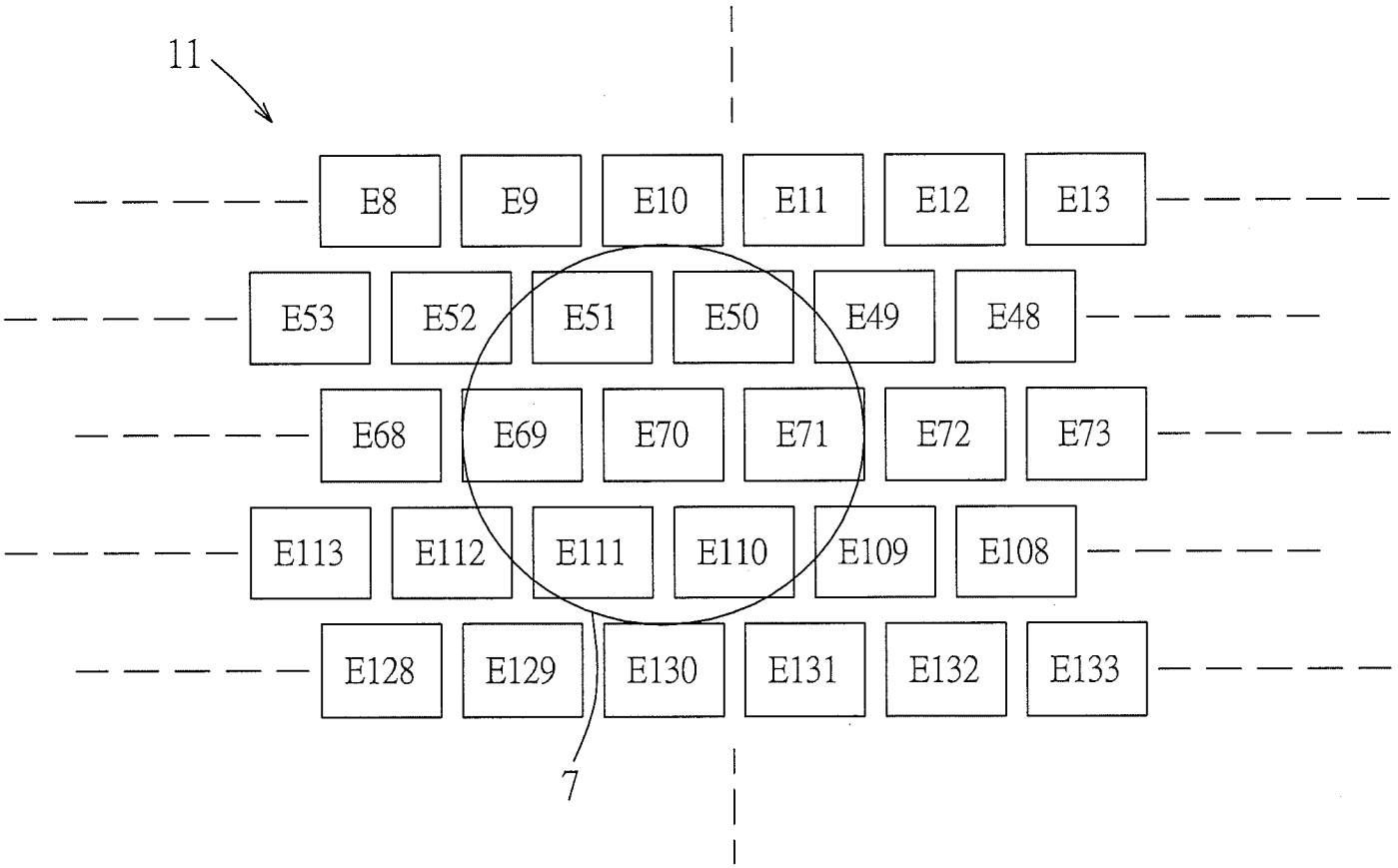
FIG. 4 is a top view of a sensor chip of the preferred embodiment to illustrate distribution of a droplet.

Referring to FIG. 4, the sensor chip 1 may operate in one of a driving mode and a sensing mode that are described hereinafter. In the following description, the droplet 7 in the droplet space 128 is exemplified to be at a position over the microelectrodes E50, E51, E69, E70, E71, E110 and E111 for illustrating the driving mode.

Referring to FIGS. 3 and 4, when the sensor chip 1 operates in the driving mode to drive movement of the droplet 7 in a direction corresponding to the microelectrodes E129-E131, the processing unit 2 sets the first control signal C1 to logic 0, and sets the clock signal CLK and a series of data input signals to store desired logic values into the D flip-flops 152 of the control units CU1-CU900, such that the D flip-flops 152 of the control units CU129-CU131 store logic 1, and the D flip-flops 152 of the other control units CU1-CU128 and CU132-CU900 store logic 0.

Then, the processing unit 2 sets the second control signal C2 to logic 1, such that the first and second transistors 156, 157 of each of the control units CU1-CU900 break electrical connections. Since the first intermediate signals n1 of the control units CU129-CU131 are logic 1, the corresponding third transistors 158 and switch components 152 make electrical connections, so that the corresponding third transistors 158 enable discharging of the microelectrodes E129-E131 to the second reference voltage V2, i.e., 0 volt. Since the first intermediate signals n1 of the other control units CU1-CU128 and CU132-CU900 are logic 0, the corresponding third transistors 158 and switch components 162 break electrical connections, so that the corresponding nodes nd have a voltage level of logic 1, and the corresponding microelectrodes E1-E128 and E132-E900 are floating.

The bias voltage signal received by the conductive layer 123 has a voltage level between a predetermined voltage and the second reference voltage V2. In this embodiment, the predetermined voltage is 60 volts. Since each of the microelectrodes E1-E128 and E132-E900 is floating, a voltage level thereat is coupled accordingly from the bias voltage signal, and is a respective floating voltage associated with the bias voltage signal. However, voltage levels at the microelectrodes E129-E131 are maintained at the second reference voltage V2 (i.e., 0 volt), so that strength of an electric field between portions of the first and second dielectric layers 121, 122 over the microelectrodes E1-E128 and E132-E900 is different from that between portions of the first and second dielectric layers 121, 122 over the microelectrodes E129-E131, thereby driving movement of the droplet 7 in the droplet space 128 in the direction of the microelectrodes E129-E131 by EWOD (electrowetting-on-dielectric).

In order to facilitate description of operation in the sensing mode, it is exemplified in the following that a number of the control units is three (i.e., CU1 to CU3), the corresponding microelectrodes are E1 to E3, and the droplet 7 in the droplet space 128 is over the microelectrode E2.

Figure 5:
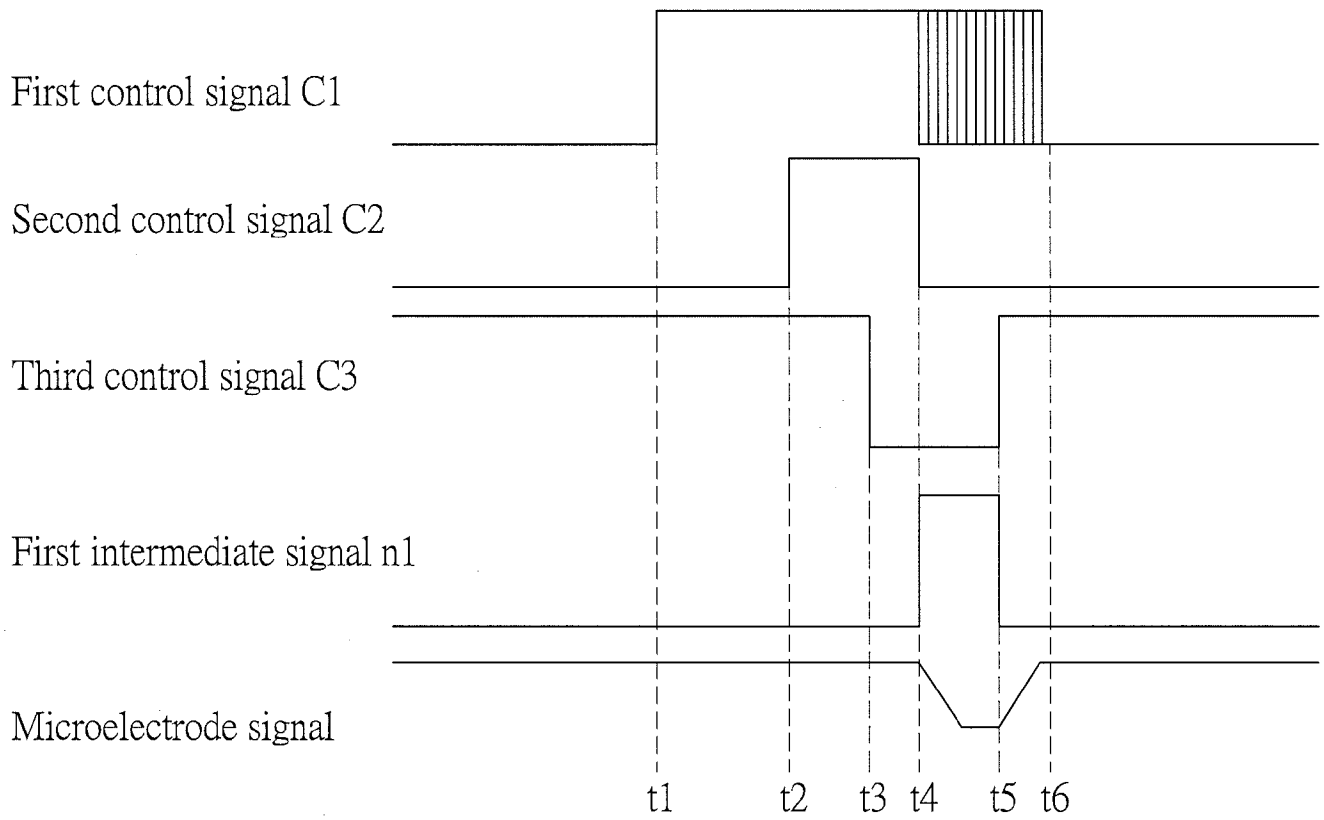
FIG. 5 is a timing diagram that illustrates relationships among some signals when the preferred embodiment operates in a sensing mode.

Referring to FIGS. 3 and 5, when the sensor strip 1 operates in the sensing mode, the voltage level of the bias voltage signal is the same as the second reference voltage V2

(i.e., 0 volt). The processing unit 2 stores logic 0 into the D flip-flop 152 of each of the control units CU1-CU3 before time t1.

During a time interval between t1 and t2, the processing unit 2 sets the first control signal C1 to logic 1, such that the first multiplexer 151 of each of the control units CU1-CU3 outputs the measurement signal received thereby.

During a time interval between t2 and t3, the processing unit 2 sets the second control signal C2 to logic 1, such that the first, second and third intermediate signals n1, n2, n3 of each of the control units CU1-CU3 are logic 0, 1 and 0, respectively, and the first, second and third transistors 156, 157, 158 and the switch component 162 of each of the control units CU1-CU3 break electrical connections. As a result, the node nd of each of the control units CU1-CU3 and the microelectrodes E1-E3 have the voltage level of the first reference voltage V1.

During a time interval between t3 and t4, the processing unit 2 sets the third control signal C3 to logic 0.

During a time interval between t4 and t5, the processing unit 2 sets the second control signal C2 to logic 0, such that the first, second and third intermediate signals n1, n2, n3 of each of the control units CU1-CU3 are logic 1, the first transistor 156 of each of the control units CU1-CU3 breaks electrical connection, and the second and third transistors 157, 158 and the switch component 162 of each of the control units CU1-CU3 make electrical connections. As a result, the third transistor 158 of each of the control units CU1-CU3 enables discharge of the corresponding one of the microelectrodes E1-E3, such that the voltage levels at the nodes nd of the control units CU1-CU3 and the microelectrodes E1-E3 reduce gradually, and the measurement signal of each of the control units CU1-CU3 has a logic value opposite to that of the voltage level of the corresponding one of the microelectrodes E1-E3.

Figure 6:
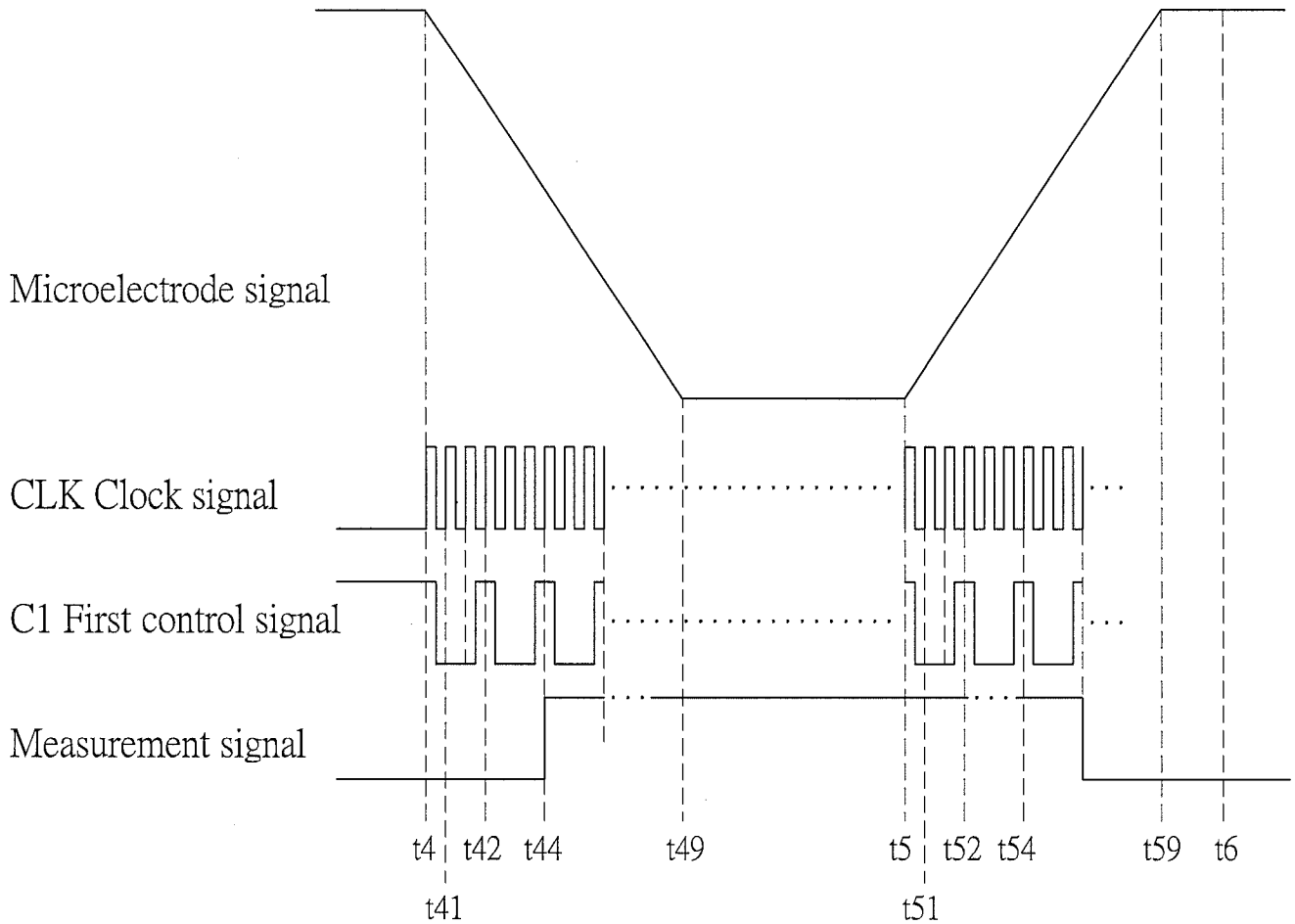
FIG. 6 is a timing diagram that illustrates relationships among some signals during a time interval between t4 and t6 of FIG. 5.

Further referring to FIG. 6, during the time interval between t4 and t41 in which the first control signal C1 is logic 1, the processing unit 2 outputs a pulse of the clock signal CLK, so as to store the logic value of the measurement signal of each of the control units CU1-CU3 at the time t4 into the D flip-flop 152 of the respective one of the control units CU1-CU3.

During the time interval between t41 and t42 in which the first control signal C1 is logic 0, the processing unit 2 outputs two pulses of the clock signal CLK, such that the processing unit 2 receives the data output signal, and sequentially reads the logic values that are stored in the D flip-flops 152 of the control units CU3-CU1 at the time t4.

The processing unit 2 repeatedly outputs the clock signal CLK and the first control signal C1 in the same manner as that during t4 and t42, so as to sequentially obtain the logic values that are stored in the D flip-flops 152 of the control units CU3-CU1 at the time t42, t44, etc., until the logic value stored in the D flip-flop 152 of each of the control units CU1-CU3 becomes logic 1.

In this embodiment, each of the time intervals between t4 and t42, t42 and t44, etc., is 1 nanosecond (ns). An equivalent capacitance value at the microelectrode E2 is 21 femtofarads (fF), and an equivalent capacitance value at each of the microelectrodes E1 and E3 is 13 fF. The logic values that are stored in the control units CU1-CU3 and that are obtained by the processing unit 2 at t4, t42 and t44 are (0, 0, 0), (1, 0, 1) and (1, 1, 1), respectively. That is, discharge time periods corresponding to the microelectrodes E1-E3 are 1 ns, 2 ns and 1 ns, respectively.

During discharge of each of the microelectrodes E1-E3 (more precisely, the discharge of an equivalent capacitor formed between each of the microelectrodes E1-E3 and the conductive layer 123), i.e., the time interval during which the voltage level decreases from the first reference voltage V1 to the second reference voltage V2, the pulses of the clock signal CLK have the same pulse width, and time intervals between two successive pulses of the clock signal CLK are the same. Therefore, the processing unit 2 may calculate the discharge time period for each of the microelectrodes E1-E3 according to the time points at which the data output signals are read out, and details thereof are described hereinafter.

The processing unit 2 obtains, during the first control signal C1 being logic 0, a series of the data output signals that includes three logic values respectively corresponding to the microelectrodes E3-E1. The processing unit 2 obtains the time point at which the logic value corresponding to the respective one of the microelectrodes E1-E3 is read out after the first control signal C1 is switched to logic 0 for a first time to serve as an initial time point of discharge corresponding to the respective one of the microelectrodes E1-E3. Moreover, the processing unit 2 obtains, during discharge of the microelectrodes E1-E3, a time point at which the logic value corresponding to the respective one of the microelectrodes E1-E3 in the series changes to serve as an end time point of discharge corresponding to the respective one of the microelectrodes E1-E3. The processing unit 2 obtains the discharge time period corresponding to the respective one of the microelectrodes E1-E3 according to the initial time point of discharge and the end time point of discharge corresponding to the respective one of the microelectrodes E1-E3.

During the time interval between t49 and t5, the third transistor 158 of each of the control units CU1-CU3 discharges the corresponding one of the microelectrodes E1-E3 to the second reference voltage V2, i.e., 0 volt.

During a time interval between t5 and t6, the processing unit 2 sets the second control signal C2 and the third control signal C3 to logic 0 and 1, respectively, such that the first, second and third intermediate signals n1, n2, n3 of each of the control units CU1-CU3 are logic 0, 0 and 1, respectively, the first transistor 156, the second transistor 157 and the switch component 162 of each of the control units CU1-CU3 make electrical connections, and the third transistor 158 of each of the control units CU1-CU3 breaks electrical connection. As a result, the first and second transistors 156, 157 of each of the control units CU1-CU3 enable charging of the corresponding one of the microelectrodes E1-E3, such that the voltage levels at the nodes nd of the control units CU1-CU3 and the microelectrodes E1-E3 increase gradually, and the measurement signal of each of the control units CU1-CU3 has a logic value opposite to that of the voltage level at the corresponding one of the microelectrodes E1 to E3.

During the time interval between t5 and t51 in which the first control signal C1 is logic 1 that is similar to the time interval between t4 and t41, the processing unit 2 outputs a pulse of the clock signal CLK, so as to store the logic value of the measurement signal of each of the control units CU1-CU3 at the time t5 into the D flip-flop 152 of the respective one of the control units CU1-CU3.

During the time interval between t51 and t52 in which the first control signal is logic 0 that is similar to the time interval between t41 and t42, the processing unit 2 outputs two pulses of the clock signal CLK, such that the processing unit 2 receives the data output signal, and sequentially reads the logic values that are stored in the D flip-flops 152 of the control units CU3-CU1 at the time t5.

The processing unit 2 repeatedly outputs the clock signal CLK and the first control signal C1 in the same manner as that during t5 and t52, so as to sequentially obtain the logic values that are stored in the D flip-flops 152 of the control units CU3-CU1 at the time t52, t54, etc., until the logic value stored in the D flip-flop 152 of each of the control units CU1-CU3 becomes logic 0.

In this embodiment, each of the time intervals between t5 and t52, t52 and t54, etc., is 1 ns. The logic values stored in the control units CU1-CU3 that are obtained by the processing unit 2 at t5, t52 and t54 are (1, 1, 1), (0, 1, 0) and (0, 0, 0), respectively. That is, charging time periods corresponding to the microelectrodes E1-E3 are 1 ns, 2 ns and 1 ns, respectively.

During the charging of each of the microelectrodes E1-E3 (more precisely, the charging of the equivalent capacitor formed between each of the microelectrodes E1-E3 and the conductive layer 123), i.e., the time interval during which the voltage level increases from the second reference voltage V2 to the first reference voltage V1, the pulses of the clock signal CLK have the same pulse width, and time intervals between two successive pulses of the clock signal CLK are the same. Therefore, the processing unit 2 may calculate the charging time period for each of the microelectrodes E1-E3 according to the time points at which the data output signals are read out, and details thereof are described hereinafter.

The processing unit 2 obtains, during the first control signal C1 being logic 0, a series of the data output signals that includes three logic values respectively corresponding to the microelectrodes E3-E1. The processing unit 2 obtains the time point at which the logic value corresponding to the respective one of the microelectrodes E1-E3 is read out after the first control signal C1 is switched to logic 0 for a first time to serve as an initial time point of charging corresponding to the respective one of the microelectrodes E1-E3. Moreover, the processing unit 2 obtains, during charging of the microelectrodes E1-E3, a time point at which the logic value corresponding to the respective one of the microelectrodes E1-E3 in the series changes to serve as an end time point of charging corresponding to the respective one of the microelectrodes E1-E3. The processing unit 2 obtains the charging time period corresponding to the respective one of the microelectrodes E1-E3 according to the initial time point of charging and the end time point of charging corresponding to the respective one of the microelectrodes E1-E3.

The processing unit 2 obtains voltage level variation at each of the microelectrodes E1-E3 according to the data output signal from the control unit CU3, calculates the discharge time period and the charging time period corresponding to each of the microelectrodes E1-E3, and determines for each of the microelectrodes E1-E3 whether or not the droplet 7 is present thereabove according to the discharge time period, the charging time period, or a difference between the discharge time period and the charging time period, so as to determine a position of the droplet 7 of the specimen. Referring to FIG. 4 as an example in which the droplet 7 is above the microelectrodes E50-E51, E69-E71 and E110-E111, an equivalent capacitance corresponding to each of the microelectrodes E50-E51, E69-E71 and E110-E111 is 21 fF, and an equivalent capacitance corresponding to each of the microelectrodes E1-E49, E52-E68, E72-E109 and E112-E900 is 13 fF, so that the charging/discharge time period corresponding to the microelectrodes E50-E51, E69-E71 and E110-E111 would be longer than that of the microelectrodes E1-E49, E52-E68, E72-E109 and E112-E900.

In addition, the processing unit 2 has a lookup table associated with pre-established relationships of charge-discharge time period data corresponding to various kinds of droplets, and further compares the discharge time period, the charging time period, or both that correspond to the respective one of the microelectrodes E1-E900 with the charge-discharge time period data, so as to obtain information of a type of the droplet 7 in the droplet space 128, thereby achieving a specimen-type readout mechanism.

The preferred embodiment of this invention has the following advantages:

1. Since the control units CU1-CU900 are coupled together in the daisy-chain configuration, only two I/O pins are required respectively for the control units CU1 and CU900. By virtue of the significantly lower I/O pin number, an area of the sensor chip 1 is not limited by the I/O pins, and may be effectively used.

2. Since each of the microelectrodes E1-E900 is controlled using a respective one of the control units CU1-CU900, the droplet 7 in the droplet space 128 may be controlled to be with a precision of an area of a microelectrode, such that the specimen may be effectively used, and the movement path of the droplet 7 may be planned as required.

3. The position of the droplet 7 may be simply and quickly determined by the processing unit 2, and the type of the droplet 7 may be determined by use of the lookup table, thereby achieving a specimen-type readout mechanism.

4. Electromagnetic interference may be effectively shielded by the shielding layer 13, so that the control units CU1-CU900 may be disposed under the microelectrodes E1-E900 without interference from the bias voltage signal at the cover 12.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

The invention claimed is:

1. A sensing system comprising:

a processing unit configured to generate a data input signal, a clock signal, and a control input; and a sensor chip including:

a microelectrode array including a plurality of microelectrodes spaced apart from each other;

a cover disposed over said microelectrode array, disposed to receive a bias voltage signal, and formed with a droplet space for accommodating a droplet; and a plurality of control units, each of which includes a data input terminal and a data output terminal, is coupled to said processing unit for receiving the clock signal and the control input therefrom, and is coupled to a corresponding one of said microelectrodes for providing a microelectrode signal thereto, wherein said data input terminal of a first one of said control units receives the data input signal from said processing unit, and said data input terminal of each of other ones of said control units is coupled to said data output terminal of another one of said control units, such that said control units are coupled together in a daisy chain configuration, wherein each of said control units is disposed under the corresponding one of said microelectrodes, and said sensor chip further includes a shielding layer disposed between said microelectrode array and said control units for shielding said control units from electromagnetic interference.

2. The sensing system as claimed in claim 1, wherein said cover includes:

a first dielectric layer disposed over said microelectrode array, and having a first surface opposite to said microelectrode array;

a second dielectric layer disposed over and spaced apart from said first dielectric layer, and having a second surface facing said first dielectric layer, and a third surface opposite to said second surface;

two hydrophobic layers respectively formed on said first surface of said first dielectric layer and said second surface of said second dielectric layer, and forming the droplet space therebetween; and a conductive layer formed on said third surface of said second dielectric layer, and disposed to receive the bias voltage signal.

3. The sensing system as claimed in claim 1, wherein said sensor chip further includes a bonding area including a data input pad coupled to said data input terminal of the first one of said control units, and a data output pad coupled to said data output terminal of a last one of said control units in the daisy chain configuration, said bonding area further including a clock signal pad and a control pad unit that are coupled to each of said control units for respectively providing the clock signal and the control input, said bonding area being disposed at a side of said microelectrode array and not being disposed under said cover.

4. The sensing system as claimed in claim 1, wherein each of said control units is configured to generate the microelectrode signal according to the clock signal, the control input, and a signal input at said data input terminal thereof, so as to drive movement of the droplet by electrowetting.

5. The sensing system as claimed in claim 4, wherein said processing unit is configured to set the data input signal, the clock signal, and the control input such that said sensor chip operates in a driving mode to drive movement of the droplet to a position that corresponds to one of said microelectrodes, where said one of said microelectrodes has a reference voltage, and the other ones of said microelectrodes are floating.

6. The sensing system as claimed in claim 1, wherein each of said control units is configured to generate at said data output terminal thereof a signal output that is selected, using the control input, from the signal input at said data input terminal thereof and a measurement signal associated with the microelectrode signal;

wherein said processing unit receives, from a last one of said control units in the daisy chain configuration, the signal output serving as a data output signal; and wherein said processing unit is further configured to set the control input and the clock signal such that said sensor chip operates in a sensing mode to sense a position of the droplet according to the data output signal.

7. The sensing system as claimed in claim 6, wherein, in the sensing mode, said processing unit is further configured to:

set the control input to cause said control units to enable discharge of said microelectrodes;

switch a voltage level of the control input during discharge of said microelectrodes to read, according to the clock signal, a series of the data output signals respectively corresponding to said microelectrodes;

obtain a discharge time period corresponding to a respective one of said microelectrodes according to a change in logic value of a corresponding one of the data output signals in the series during discharge of said microelectrodes; and determine the position of the droplet according to the discharge time periods obtained for said microelectrodes.

8. The sensing system as claimed in claim 7, wherein, in the sensing mode, said processing unit is further configured to:

obtain, for a respective one of said microelectrodes during discharge of said microelectrodes, a time point at which a logic value corresponding to the respective one of said microelectrodes is read out after the control input is switched to read the series of the data output signals for a first time to serve as an initial time point of discharge corresponding to the respective one of said microelectrodes;

obtain, during discharge of said microelectrodes, an end time point of discharge corresponding to the respective one of said microelectrodes according to the change in logic value of a corresponding one of the data output signals in the series; and obtain the discharge time period corresponding to the respective one of said microelectrodes according to the initial time point of discharge and the end time point of discharge corresponding to the respective one of said microelectrodes.

9. The sensing system as claimed in claim 8, wherein, in the sensing mode, said processing unit is further configured to:

set the control input to cause said control units to enable charging of said microelectrodes;

switch the voltage level of the control input during charging of said microelectrodes to read, according to the clock signal, a series of the data output signals respectively corresponding to said microelectrodes;

obtain, for a respective one of said microelectrodes during charging of said microelectrodes, a time point at which a logic value corresponding to the respective one of said microelectrodes is read out after the control input is switched to read the series of the data output signals for a first time to serve as an initial time point of charging corresponding to the respective one of said microelectrodes;

obtain, during charging of said microelectrodes, an end time point of charging corresponding to the respective one of said microelectrodes according to the change in logic value of a corresponding one of the data output signals in the series;

obtain a charging time period corresponding to the respective one of said microelectrodes according to the initial time point of charging and the end time point of charging corresponding to the respective one of said microelectrodes; and determine the position of the droplet according to the discharge time period and the charging time period corresponding to the respective one of said microelectrodes.

10. The sensing system as claimed in claim 7, wherein, in the sensing mode, said processing unit is further configured to:

set the control input to cause said control units to enable charging of said microelectrodes;

switch the voltage level of the control input during charging of said microelectrodes to read, according to the clock signal, a series of the data output signals respectively corresponding to said microelectrodes;

obtain a charging time period corresponding to a respective one of said microelectrodes according to a change in logic value of a corresponding one of the data output signals in the series during charging of said microelectrodes; and determine the position of the droplet according to the discharge time period and the charging time period corresponding to the respective one of said microelectrodes.

11. The sensing system as claimed in claim 6, wherein, in the sensing mode, said processing unit is further configured to:

set the control input to cause said control units to enable charging of said microelectrodes;

switch a voltage level of the control input during charging of said microelectrodes to read, according to the clock signal, a series of the data output signals respectively corresponding to said microelectrodes;

obtain a charging time period corresponding to a respective one of said microelectrodes according to a change in logic value of a corresponding one of the data output signals in the series during charging of said microelectrodes; and determine the position of the droplet according to the charging time period corresponding to the respective one of said microelectrodes.

12. The sensing system as claimed in claim 10, wherein said processing unit has a lookup table associated with pre-established relationships of charge-discharge time period data corresponding to various kinds of droplets, and is further configured to compare the discharge time period and the charging time period that correspond to the respective one of said microelectrodes with the charge-discharge time period data, so as to obtain information of a type of the droplet in the droplet space.

13. A sensor chip comprising:

a microelectrode array including a plurality of microelectrodes spaced apart from each other;

a cover disposed over said microelectrode array, disposed to receive a bias voltage signal, and formed with a droplet space for accommodating a droplet; and a plurality of control units, each of which includes a data input terminal and a data output terminal, is disposed to receive a clock signal and a control input, and is coupled to a corresponding one of said microelectrodes for providing a microelectrode signal thereto, wherein said data input terminal of a first one of said control units is disposed to receive a data input signal, and said data input terminal of each of other ones of said control units is coupled to said data output terminal of another one of said control units, such that said control units are coupled together in a daisy chain configuration, wherein each of said control units is disposed under the corresponding one of said microelectrodes, said sensor chip further comprising a shielding layer disposed between said microelectrode array and said control units for shielding said control units from electromagnetic interference.

14. The sensor chip as claimed in claim 13, wherein said cover includes:

a first dielectric layer disposed over said microelectrode array, and having a first surface opposite to said microelectrode array;

a second dielectric layer disposed over and spaced apart from said first dielectric layer, and having a second surface facing said first dielectric layer, and a third surface opposite to said second surface;

two hydrophobic layers respectively formed on said first surface of said first dielectric layer and said second surface of said second dielectric layer, and forming the droplet space therebetween; and a conductive layer formed on said third surface of said second dielectric layer, and disposed to receive the bias voltage signal.

15. The sensor chip as claimed in claim 13, further comprising a bonding area that includes a data input pad coupled to said data input terminal of the first one of said control units, and a data output pad coupled to said data output terminal of a last one of said control units in the daisy chain configuration, said bonding area further including a clock signal pad and a control pad unit that are coupled to each of said control units for respectively providing the clock signal and the control input, said bonding area being disposed at a side of said microelectrode array and not being disposed under said cover.

16. The sensor chip as claimed in claim 13, wherein each of said control units is configured to generate the microelectrode signal according to the clock signal, the control input, and a signal input at said data input terminal thereof, so as to drive movement of the droplet by electrowetting.

* * * * *